US007041188B2

(12) United States Patent
Bleckmann

(10) Patent No.: US 7,041,188 B2
(45) Date of Patent: May 9, 2006

(54) METHOD FOR PRODUCING MITER FOLD LABELS

(75) Inventor: Frederick Bleckmann, Barrington, NH (US)

(73) Assignee: Pittsfield Weaving Co., Inc., Pittsfield, NH (US)

( * ) Notice: Subject to any disclaimer, the term of this patent is extended or adjusted under 35 U.S.C. 154(b) by 154 days.

(21) Appl. No.: 10/747,249

(22) Filed: Dec. 30, 2003

(65) Prior Publication Data

US 2004/0244902 A1 Dec. 9, 2004

Related U.S. Application Data

(60) Provisional application No. 60/437,094, filed on Dec. 30, 2002.

(51) Int. Cl.
*G09F 3/00* (2006.01)

(52) U.S. Cl. ..... 156/227; 156/257; 156/268; 493/356; 493/361

(58) Field of Classification Search ..... 156/73.3, 156/204, 227, 308.4, 257, 268; 493/361, 493/364, 341, 356; 83/51
See application file for complete search history.

(56) References Cited

U.S. PATENT DOCUMENTS 3,844,201 A * 10/1974 Eggert et al. ..... 493/355

FOREIGN PATENT DOCUMENTS

WO WO 01/34888 A1 * 5/2001

* cited by examiner

*Primary Examiner*—Sam Chuan Yao
*Assistant Examiner*—Barbara J. Musser
(74) *Attorney, Agent, or Firm*—Corinne R. Gorski; Nixon Peabody, LLP

(57) ABSTRACT

A device and method for producing individual folded labels having miter folded tabs includes a first cutting station for partially cutting the ribbon of labels to form a tab at each edge of the ribbon of labels and an interior base cut. The ribbon of label remains intact at a pair of connection points separating the tabs. The tabs are folded at an angle to produce a miter fold at a folding station. A second cutting station ultrasonically cuts the miter folded ribbon of labels along the connection points to subdivide the ribbon of labels into separate, individual folded labels.

3 Claims, 5 Drawing Sheets

METHOD FOR PRODUCING MITER FOLD LABELS

RELATED APPLICATIONS

This application claims priority of U.S. Provisional Application Ser. No. 60/437,094 filed Dec. 30, 2002.

This application is also related to U.S. patent application Ser. No. 09/603,234 now U.S. Pat. No. 6,432,235 entitled "Method and Apparatus for Production of Labels"; Ser. No. 10/143,867 now U.S. Pat. No. 6,830,639 entitled "Method and Apparatus for Production of Labels"; and Ser. No. 10/143,842 now U.S. Pat. No. 6,827,187 entitled "Method and Apparatus for Production of RF Labels."

BACKGROUND OF THE INVENTION

1. Field of the Invention

The present invention relates to a device for producing miter folds in a ribbon of individually cut labels and more particularly, a method for producing the miter fold labels.

2. Description of the Related Art

The attachment of labels to cloth goods such as clothing, linens and towels is a common practice used to set forth information such as trademarks and trade names, material identification and characteristics, sizes, care instructions, and so forth. In addition, legal requirements necessitate the use of labels in clothing or on linens. A method and apparatus for producing individual folded labels from a ribbon of labels is presented in U.S. Pat. No. 6,432,235 and is incorporated in its entirety herein.

Folded labels are commonly used in the industry and come in a number of different forms including endfolds, centerfolds, J folds, Booklet fold, Manhattan-folds, and miterfold labels. While each of these different forms has a particular use, the centerfold and end-fold labels are the most popular.

In addition to providing this important information, the label is part of the object. Unfortunately, it is not unusual for a label, especially a skin contact clothing label, to irritate the customer. This can result in the customer forming a negative attitude regarding the quality of the entire garment. Quite often the customer will cut the offending label out of the garment. This not only prevents the customer from having the proper care instructions, it also removes the product identification from the garment, further reducing repeat sales.

Currently most folded labels are produced using what is referred to in the industry as the "cut and fold" technique, that is the labels are indexed, cut from a ribbon of material and then folded. Using this technique about 40–220 labels can be produced a minute with between 5–20% of the labels being considered waste or defective. The most common defect being a distorted fold resulting in the ends of the label not aligning properly. Other defects include turned corners, fanning, and protruding fold-unders.

Defective labels can significantly increase the cost of the goods. For example, while it costs only about fifteen to twenty-five cents to sew a label into a garment in the United States, it can cost five to ten times this amount to replace a defective label. Many labels, especially centerfold, have a tendency to skew while being sewed, thereby increasing the chance for a poor impression.

In many cases of using labeling on a garment, there are variable pieces of information which may be needed, differing from garment to garment. These bits of multiple information can be presented on a single label, causing the need for small runs in production, which raises production costs. Multiple labels for size and special instructions can also be used. This too adds to production costs because sewing time for the garment manufacturers is increased.

It would be desirable to produce large productions runs of a main label and include additional variable pieces of information on a smaller piece of fabric attachable to the main label at the point of label processing.

SUMMARY OF THE INVENTION

An object of the present invention is to produce an individual label having miter folded tabs.

Another object of the present invention is to provide an individual label having tabs folded at an angle prior to cutting the finished label.

In accomplishing these and other objects of the present invention, there is provided a method for producing individual folded labels having miter folded tabs, the method comprising the steps of providing a ribbon of labels, the ribbon of labels having opposed edges along its length, partially cutting the ribbon of labels to form a tab at each edge and at least connection point disposed between the tabs, folding each of the tabs of the ribbon of material; and cutting the folded ribbon of labels along the at least one connection point to subdivide the ribbon of labels into individual folded labels.

In accomplishing these and other objects of the present invention, there is provided a device for producing individual folded labels having miter folded tabs including a mechanism for linearly advancing a ribbon of labels. The ribbon of labels includes opposed edges along its length. A first means partially cuts the ribbon of labels to form a tab at each edge of the ribbon of labels. The tabs are separated by at least one connection point. Means fold the tabs at an angle. Second cutting means ultrasonically cut the ribbon of labels along the at least one connection point to subdivide the ribbon of labels into separate, individual labels.

These and other objects, features, aspects, and advantages of the present invention will become more apparent from the following detailed description of the preferred embodiment relative to the accompanied drawings, in which:

DETAILED DESCRIPTION OF PREFERRED EMBODIMENTS

Figure 1:
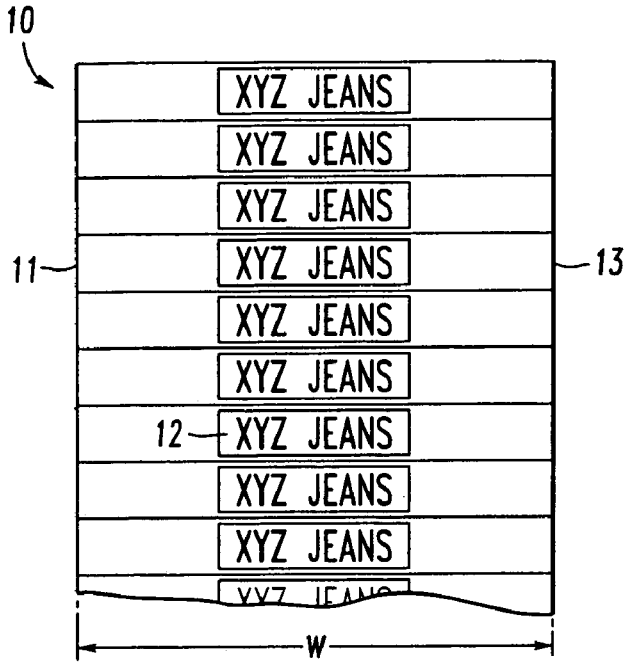
FIG. 1 illustrates a ribbon of labels prior to being cut and folded.

For a general understanding of the features of the present invention, reference is made to the drawings, wherein like reference numerals have been used throughout to identify identical or similar elements. FIG. 1 shows a ribbon of labels 10. As shown, ribbon of labels 10 is made up of a plurality of logo or text 12 to form the ribbon of labels. The ribbon of labels 10 can be composed of virtually any material that can be cut and pressed including a thermoplastic material (e.g., polyester), acetate, cotton, nylon, linen, paper, rayon and combinations thereof, in woven and non-woven form. Polyester is preferred. The labels can be printed on non-woven, printed on woven or jacquard woven. Jacquard woven is preferred. be woven or printed thereon.

Figure 2:
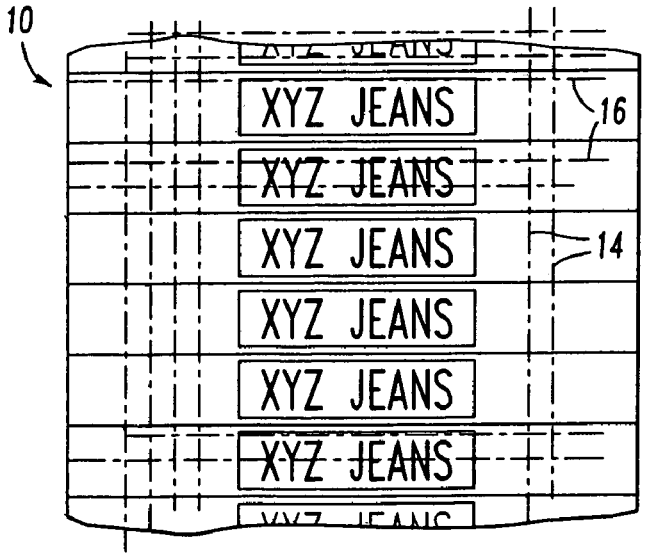
FIG. 2 illustrates the warp and weft yarns of the ribbon of labels of FIG. 1.

Ribbon of labels 10 has a fixed width w along its length. Ribbon of labels 10 also has two opposed edges 11, 13 along its length. Edges 11, 13 can be loom cut, woven or cold slit edges. As shown in FIG. 2, ribbon of labels 10 is made up of warp yarn 14 or y-axis yarn and weft yarn or x-axis yarn 16 that make up the fabric of the ribbon.

Figure 3:
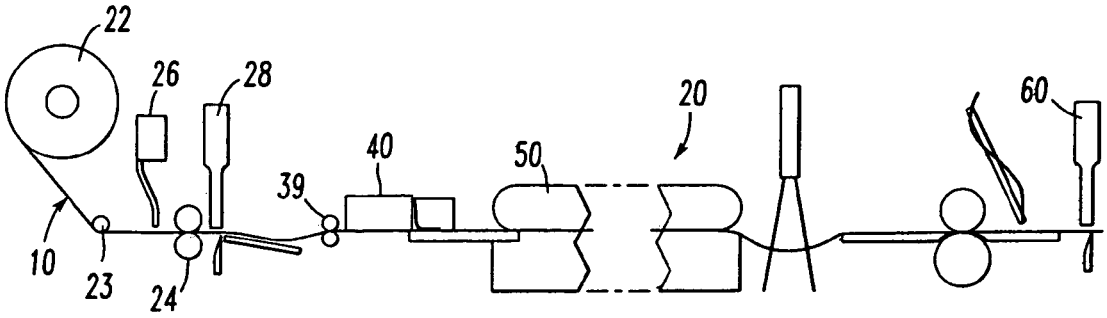
FIG. 3 is a perspective view of the miter folding device of the present invention.

The miter folding device 20 of the present invention is illustrated in FIG. 3 and includes a tension let-off device 22, an indexing device 24, a first sensor 26, a first cutting station 28, a folding station 40, a press station 50 and a second cutting station 60. A roll of a ribbon of labels 10 is placed on tension let-off device 22. Regulating the tension from let-off device 22 to press station 30 is important for controlling the ribbon of labels 10 during the folding process. From the tension let-off device the ribbon of labels is guided by rollers 23 and indexing device 24 past sensor eye 26. In order to maintain the proper alignment for the roll of material and logos 12 an observation system such as a fiber optic eye 26 is used. Sensor eye 26 reads color contrast as the material advances. When the eye sees a color change an interrupt signal is sent to a controller (not shown) to stop the advance of the material for cutting in station 28. Thus, the first cut at station 28 is registered in relation to the logo or text 12 of the ribbon.

Figure 4:
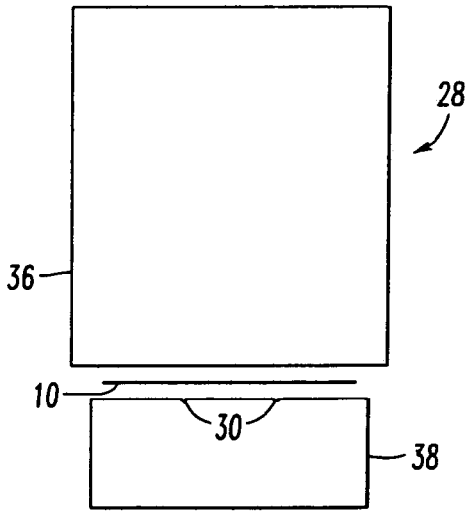
FIG. 4 is a cross-sectional view of the first cutting station of the device of FIG. 3.

After passing sensor 26 the ribbon of labels 10 is delivered to the first cutting station 28 and stopped as described above. As shown in FIG. 4, the first cutting station 28 includes an ultrasonic horn 36 and an anvil or knife 38. The knife 38 is actuated to collide with horn 36. As the ribbon of labels 10 passes through horn 36 and anvil 38 the material is exposed to a very high, localized heat, cutting and sealing the material. Knife or anvil 38 is disposed such that the ribbon of labels is cut perpendicular to the ribbon edges 11, 13. This cut is also referred to as the folding cut, which will be described further herein. It should be appreciated that other known cutting techniques can be utilized to subdivide the ribbon of labels into individual labels.

Figure 5:
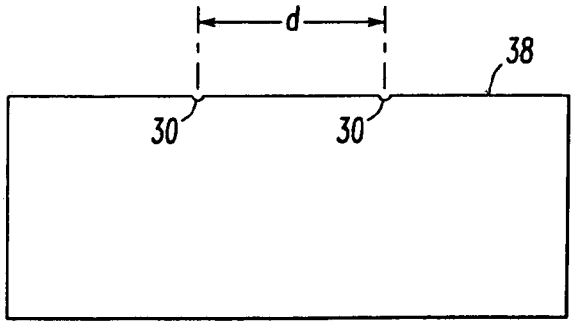
FIG. 5 is an enlarged view of the cutting knife of FIG. 4.

As shown in FIGS. 4 and 5, knife or anvil 38 includes indentations 30 along its upper cutting edge. Indentations 30 prevent the ribbon of material from being completely cut in station 28. Indentations 30 can be spaced by a distance d, which can be adjusted depending upon the specific size of the ribbon of labels 10.

Figure 6:
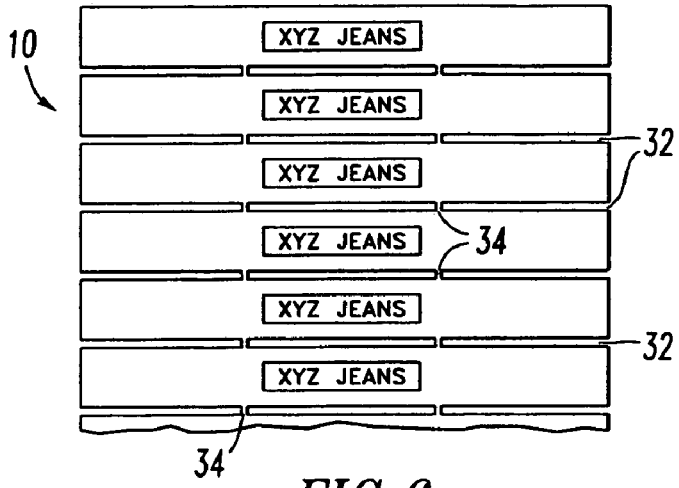
FIG. 6 illustrates the ribbon of labels after it has been cut by the first cutting station of FIG. 3.
Figure 8:
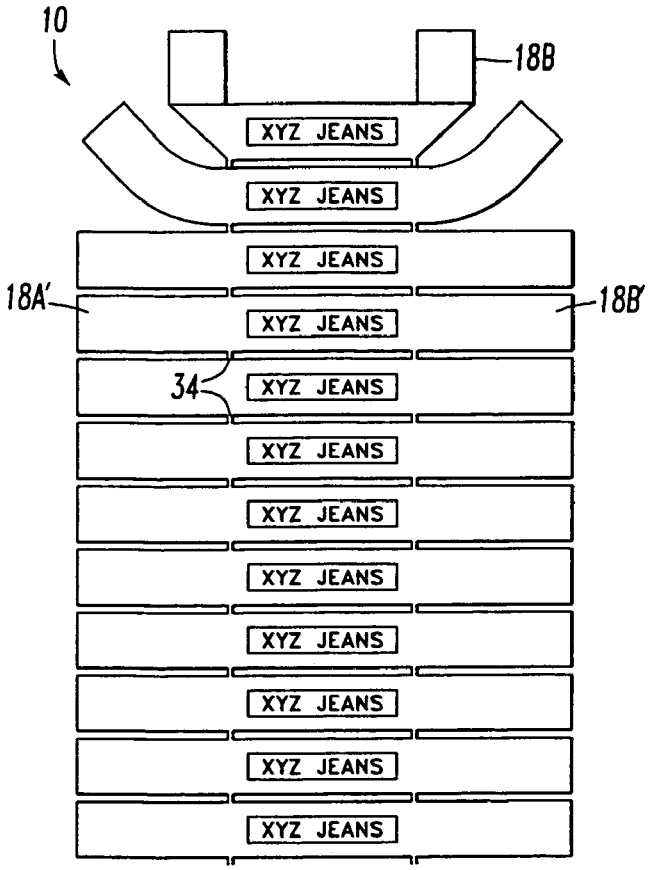
FIG. 8 illustrates the folding of the tabs of the individual labels of the ribbon of labels of FIG. 6.
Figure 9:
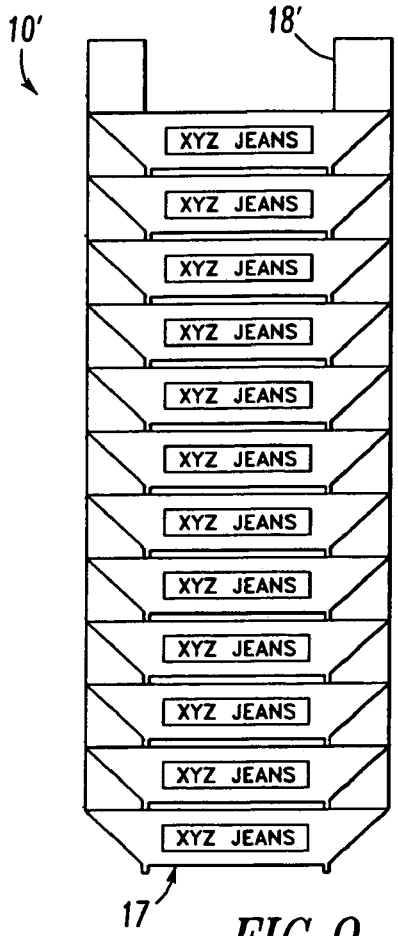
FIG. 9 illustrates the folded ribbon of labels.
Figure 10:
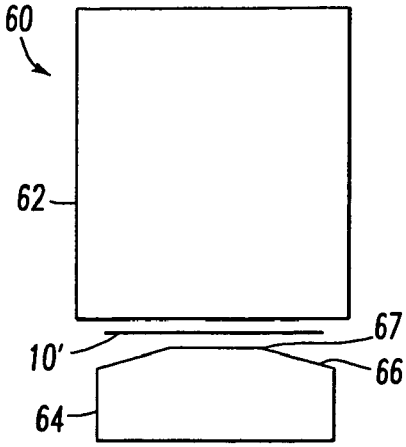
FIG. 10 illustrates a folded individual cut label.

Referring to FIG. 6, in first cutting station 28, the ribbon of labels is cut through at points 32 with the exception of locations 34. A base cut 17 (FIGS. 9 and 10), which corresponds to the distance d of FIG. 5, is also performed. Thus, the first cutting station 28 cuts and seals individual labels from ribbon of material 10 only at points 32 and not at locations 34 allowing the individual labels to leave first cutting station 28 partially connected. Thus, first cutting station 28 cuts a partial distance of the width of the ribbon. Folding cuts 32 form the tabs 18*a* and 18B of the label, as shown in FIGS. 8–10. Locations or connection points 34 are disposed on each side of the base cut 17. The location of these non-cut area or connection points 34 is important to and influences the location of the fold. The points 34 that are left uncut allow the ribbon to stay intact.

The folding cut 32 forming the tabs is determined as the width of the ribbon minus base cut 17's dimension "d" divided by two. This cut distance determines the fold dimensions of the label and the size of the tabs 18 (FIG. 8). The label is cut on the outer portion to free the flaps of the label which fold back forming the miter fold. As shown in the drawings the label is cut in all but the two points 34 allowing the ribbon to remain manageable.

After passing through first cutting station 28, the partially cut ribbon of labels travels to folding station 40 via rollers 39. Referring to FIGS. 7A–7F, the folding station 40 includes three major components; a lower folding pan 42, support rod 44 and folding plates 46.

Figure 7A:
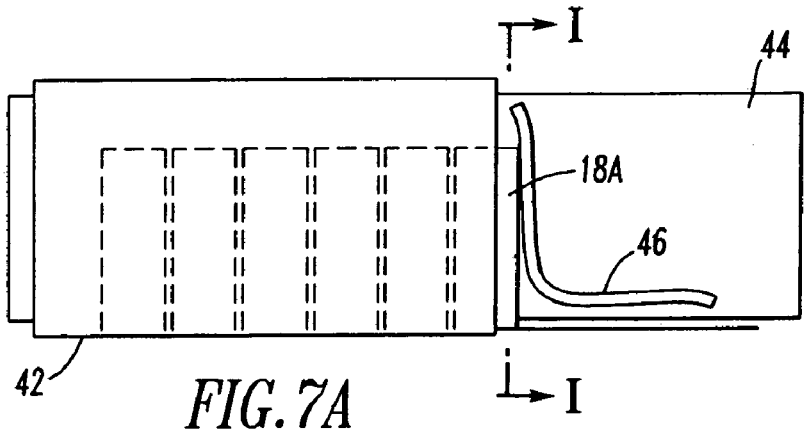
FIGS. 7A–7F illustrate the folding station of the device of FIG. 3.
Figure 7B:
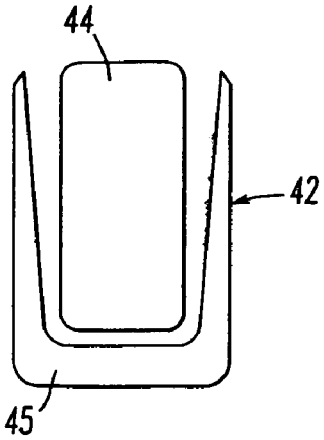

Referring to FIGS. 7A and 7B, the ribbon of material is advanced through folding pan 42. FIG. 7B is a cross-section of folding pan 42 and support rod 44 without ribbon of labels 10. Folding pan 42 has upwardly extending sides 41 and 43 forming a u-shape. Support Rod 44 is disposed within pan 42 between sides 41, 43. Pan 42 and support rod 44 force the partially cut ribbon 10 to take a U-shape. The bottom flat dimension of the base 45, which is the distance between sides 41, 43 of the folding pan 42 determined by dimension 17 (FIG. 10).

Figure 7C:
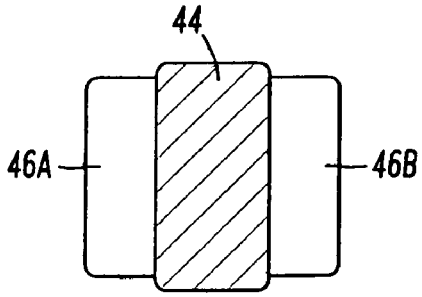

As shown in FIGS. 7A and 7C, FIG. 7C being a cross-section of FIG. 7A taken along line I—I, folding station 40 includes a pair of folding plates 46A and 46B disposed on either side of rod 44 and located downstream of pan 42 in the direction of ribbon advancement. Folding plates 46A, B are shaped as shown to facilitate the folding of the tabs. It should be appreciated that the plates can take on different configurations depending on the desired folds and dimensions.

Figure 7D:
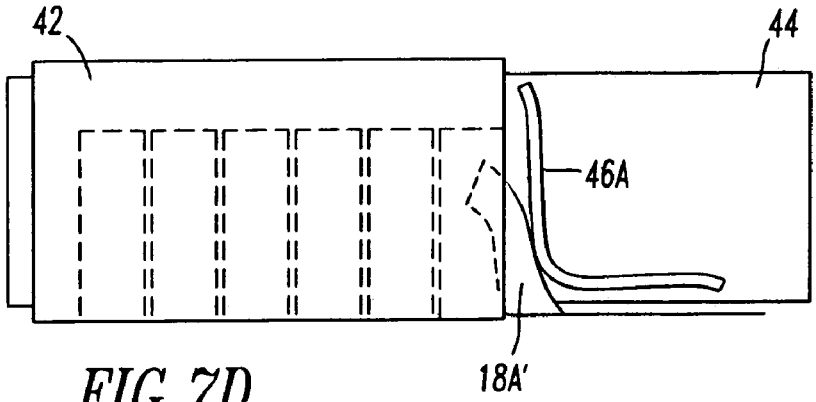
Figure 7E:
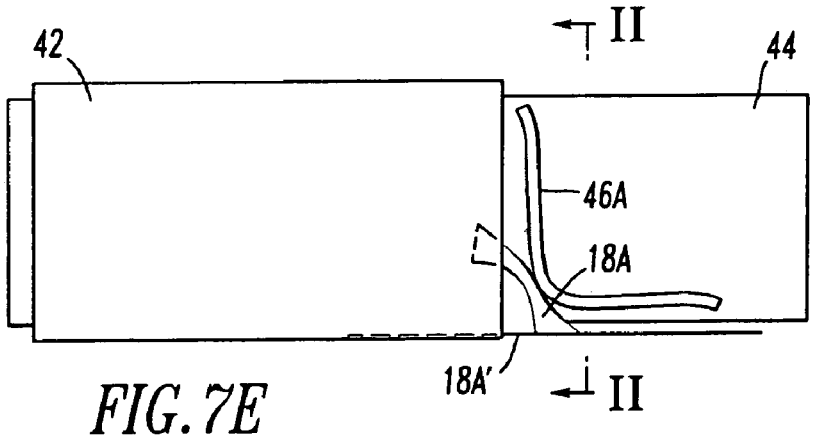
Figure 7F:
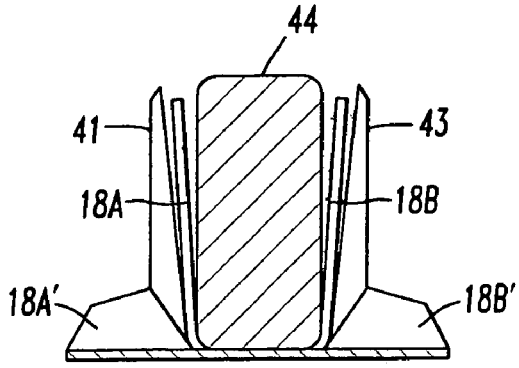

As shown in FIGS. 7D–F, as ribbon of labels 10 exits folding pan 42 tabs 18A and 18B formed by cuts 32 are brought into contact with the folding plates 46A and 46B. Referring to FIG. 7D, folding plates 46A and 46B push tabs 18A and 18B back as ribbon 10 advances. As shown in FIGS. 7E and 7F, FIG. 7F being a cross-sectional view of FIG. 7E taken along line II—II, tabs 18A' and 18B' are folded down as the ribbon advances and below the next set of tabs to be folded 18A and 18B. Thus, tabs 18A' and 18B' hold down tabs 18A and 18B.

The progressive folding of tabs 18A and 18B is illustrated in FIG. 8. As shown, the tabs are angled upward as they progress through the folding station. The finished label shown in FIG. 11 has folded tabs 18' folded at an angle indicated by element 19. Preferably angle 19 is in the range of 45 degrees to form a miter fold, hence a fold which is not perpendicular or parallel to the ribbon edges. A lower fold point 19A (FIG. 11) is determined by points of connection 34. It should be appreciated that other fold angles are contemplated by the present invention depending upon the desired dimensions of the finished label.

Figure 11:
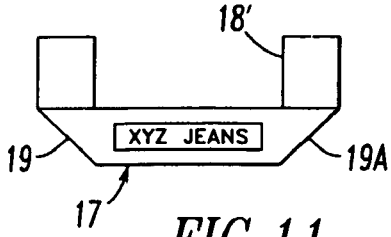
FIG. 11 is a cross-sectional view of the second cutting station of the device of FIG. 3.

The completed folded ribbon of labels is shown in FIG. 9. After exiting folding station 40 the ribbon of labels is then advanced to press station 50 (FIG. 3) where the folds are set with heat and pressure as disclosed in U.S. Pat. No. 6,432,235. After being treated in folding station 50, the ribbon of folded labels 10' travels to a second cutting station 60 in the same manner as disclosed in U.S. Pat. No. 6,432,235. As shown in FIG. 10 of the present invention, second cutting station 60 comprises an ultrasonic horn 62 and an anvil or knife 64. Knife 64 is angled at 66 so as to cut through the point of connections 34 only along cutting edge 67, thus not cutting folded tabs 18', producing individual folded labels as shown in FIG. 11.

Alternatively, the folded ribbon of the present invention could be produced by a device having only a single sensor and cutting station whereby the ribbon of labels is passed twice through the device such as the apparatus of U.S. Pat. No. 6,432,235. Instead of having two cutting stations on one apparatus, the ribbon could be run through an apparatus with one cutting station twice, although the knife would need to be changed as to perform the first and second cuts correctly. For a miter fold as taught by the invention, the first cut must be to a partial of the ribbon width, with the "non-cut area" being located to benefit the fold. The cut area thereby forming the tab. Prior to the first cut the ribbon could be folded as to have a fold, one such fold could be an end fold as described in the '235 patent, in which case the end product "the miter fold label" would also have the ends of the tabs folded over and this folded tabs would be bonded together along the cut edge as in the '235 patent. The advantage to this is that it would be in proper form to be sewn over a seam in this configuration. Later during the second pass, the second cut is registered to impact the same location separating the remaining portion which holds the ribbon together.

Although the present invention has been described in relation to particular embodiments thereof, many other variations and modifications and other uses will become apparent to those skilled in the art. It is preferred therefore, that the present invention be limited not by the specific disclosure herein, but only by the appended claims.

What is claimed is:

1. A method for producing individual folded labels having folded tabs, the method comprising the steps of:

providing a ribbon of labels, the ribbon of labels having opposed edges along its length;

partially cutting the ribbon of labels to form a tab at each edge and at least one connection point disposed between the tabs;

folding each of the tabs at an angle to the at least one connection point; and cutting the folded ribbon of labels along the at least one connection point to subdivide the ribbon of labels into individual folded labels.

2. The method of claim 1, further comprising the step of subjecting the folded ribbon of labels to sufficient heat and pressure to set the folds.

3. The method of claim 1, wherein the step of partially cutting the ribbon of labels comprises simultaneously cutting the label from both edges of the ribbon of labels to form the tabs and cutting an interior base cut.

* * * * *